US007350490B2

(12) United States Patent
Mock et al.

(10) Patent No.: US 7,350,490 B2
(45) Date of Patent: Apr. 1, 2008

(54) CONNECTION ELEMENT FOR THE CAPTIVE MOUNTING OF A LEVER-LIKE CAM FOLLOWER

(75) Inventors: Stephan Mock, Pretzfeld (DE); Helmut Engelhardt, Herzogenaurach (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/574,190

(22) PCT Filed: Aug. 3, 2005

(86) PCT No.: PCT/EP2005/008396

§ 371 (c)(1),
(2), (4) Date: Feb. 23, 2007

(87) PCT Pub. No.: WO2006/021300

PCT Pub. Date: Mar. 2, 2006

(65) Prior Publication Data

US 2007/0215086 A1 Sep. 20, 2007

(30) Foreign Application Priority Data

Aug. 26, 2004 (DE) ..... 10 2004 041 231

(51) Int. Cl.
*F01L 1/18* (2006.01)

(52) U.S. Cl. ..... 123/90.39; 123/90.16; 123/90.41; 123/90.44

(58) Field of Classification Search ..... 123/90.35, 123/90.16, 90.41, 90.44, 90.27; 74/559
See application file for complete search history.

(56) References Cited

U.S. PATENT DOCUMENTS 6,047,675 A 4/2000 Kunz 6,491,012 B2 * 12/2002 Pryba et al. ..... 123/90.41

FOREIGN PATENT DOCUMENTS

| | | |
|---|---|---|
| DE | 3302194 | 8/1983 |
| DE | 29707987 | 8/1997 |
| DE | 19617523 | 11/1997 |
| DE | 10249560 | 5/2004 |
| WO | 2004038185 | 5/2004 |

* cited by examiner

*Primary Examiner*—Zelalem Eshete
(74) *Attorney, Agent, or Firm*—Volpe and Koenig, P.C.

(57) ABSTRACT

A connection element (9, 10) is provided for the captive mounting of a lever-type cam follower (1), which is used to actuate a gas-exchange valve (5) of an internal combustion engine, on a support element (2). Said support element (2) has a spherical end (7) on which the cam follower (1) is pivotably mounted by a concave molding (6). The connection element (9, 10) is made from a flat material and is arranged, with a central section (11), on a bottom side (12) of a base (13) facing the support element (2). The base surrounds the concave molding (6) and connects to the side walls (27) of the cam follower (1). The central section forms, with two limbs (14) that are spaced apart from each other and a web (15) connected with the limbs, a U-shaped recess (16), which extends in a longitudinal direction of the cam follower (1) and which surrounds, in an essentially play-free manner, an annular groove (8) below the spherical end (7) in a fork-like manner and orthogonal to a pivoting direction of the cam follower (1). The limbs (14) transition into retaining grips (17) offset by approximately 90° and the web (15) transitions into a support wall (18) offset by approximately 90°. Retaining lugs (19, 20) located on the retaining grips and the support wall are engaged on a top side (21) of the base (13) facing away from the support element (2) for holding the connection element (9, 10) on the cam follower (1). The retaining grips (17) are supported on inner sides (26) of the side walls (27) of the cam follower (1) such that the U-shaped recess (16) is essentially fixed in position in a perpendicular direction relative to the cam follower (1) and in terms of a shape thereof.

3 Claims, 3 Drawing Sheets

CONNECTION ELEMENT FOR THE CAPTIVE MOUNTING OF A LEVER-LIKE CAM FOLLOWER

BACKGROUND

The invention relates to a connection element for the captive mounting of a lever-type cam follower, which is used to actuate a gas-exchange valve of an internal combustion engine, onto a support element with a spherical end. The cam follower is pivotably mounted on the spherical end via a concave molding. Here, the connection element made from flat material is arranged, with a central section, on a lower side of a base, which is oriented towards the support element. This base surrounds the concave molding and connects to side walls of the cam follower. The connection element forms, with two limbs spaced apart at a distance from each other and also a web connecting these limbs, a U-shaped recess, which extends in a longitudinal direction of the cam follower and which surrounds a ring-shaped groove below the spherical end in a fork-like manner.

In a known way, such connection elements allow the generation of a component, which includes, for example, a finger lever as a cam follower and a support element. Such a component then minimizes the risk of potentially incorrect assembly by the customer. Among other things, this could consist in the finger lever being mounted rotated by 180° in the valve train. In this case, the contact partners of the spherical head of the support element and the spherical cap of the finger lever and also the valve shaft end and the corresponding counter surface on the finger lever being interchanged. Such an incorrect assembly would lead at least to incorrect functioning of the valve train and even, in the worst case, to serious engine damage. Additional requirements on this connection element consist in that, on one side, a separation of the finger lever and support element due to transport effects is reliably ruled out and, on the other side, the connection element does not contribute disadvantageously to valve-drive wear in the pivoting motion of the finger lever on the support element.

In DE 196 17 523 C2, different variants of a connection element satisfying the requirements noted above are proposed. This connection element engages in the ring-shaped groove below the spherical end for captive connection of the finger lever and support element. The material thickness of the connection element is matched to a width of the groove, so that it can move freely in the groove into every pivoting position of the finger lever. Thus, the finger lever can execute a pivoting motion in the actuation direction of the gas-exchange valve, which is not impaired by frictional effects of the connection element. In one of these variants according to the FIGS. 3 and 4 of the mentioned publication, the connection element is made of flat material and surrounds the finger lever at the concave molding in a U-shaped configuration with two limbs oriented in the direction of the gas-exchange valve. At their end, these limbs transition into retaining lugs, which snap behind the material surrounding the concave molding for fixing the connection element in the longitudinal direction of the finger lever. Furthermore, in this variant, the limbs form a U-shaped recess and surround the annular groove in a fork-like manner. The U-shaped recess is here embodied open towards the gas-exchange valve.

In general, in the assembly of the finger lever with the support element, it is typical to clip the spherical end of the support element behind a recess of the connection element engaging in the groove. In this way, the connection element is already mounted on the finger lever. Such an assembly process is now also possible and is to be performed only using these means for the previously mentioned variants of the cited publication. This is based on the condition that pushing the connection element in the longitudinal direction onto the finger lever is not possible for a spherical end of the support element held in the concave molding, because the retaining lugs necessary for attachment spread out the lower limb of the connection element before reaching the end position and would collide with the piston periphery of the support element below the annular groove.

A prerequisite for trouble-free clipping of the support element behind the recess of the connection element is now its elastic deformation in the area of the recess. The necessary elasticity can be achieved without a problem through the suitable geometry of the recess and also suitable properties and thickness of the connection element material. Nevertheless, a mounting gap remains perpendicular to the actuation direction of the finger lever between the connection element and the annular groove in the support element. Consequently, the finger lever is also not completely hindered by the connection element for a pivoting motion perpendicular to its actuation direction, wherein this pivoting motion can then equal up to 15°. Such tipping of the finger lever about its longitudinal axis can also occur when it is mounted in the internal combustion engine, namely if there is a loss of contact between the finger lever and the actuating cam. Causes for such a loss of contact can be an undesired lowering of the usual support element with hydraulic lash compensation or jumping of the finger lever from the actuated cam as a result of overspeed in the internal combustion engine.

In this respect, in particular, finger levers with very narrow cam contact surfaces are to be considered. These can be used in installation space-limited multi-valve engines or also in variable valve controllers, in which a cam arrangement comprising several cams of different stroke is mounted so that it can be displaced axially on its camshaft and is brought into engagement with the finger lever by the one cam matching the operating state of the internal combustion engine. The finger lever is then especially at risk in terms of further or complete tipping of the support element, because it may no longer be sufficiently aligned with the cam due to the narrow cam contact surface when contact to its cam is restored.

SUMMARY

Therefore, the object of the invention is to provide a connection element of the type named above, in which the cited disadvantages are overcome, so that a stable alignment on the actuating cam can be guaranteed in all operating states of the internal combustion engine especially for cam followers with narrow cam contact surfaces.

The solution of this objective emerges from the features of claim 1, while advantageous refinements and constructions are to be taken from the dependent claims.

Consequently, the objective is met in that the U-shaped construction surrounds the groove orthogonal to the pivoting direction of the cam follower essentially without play, wherein the limbs transition into retaining grips offset by approximately 90° and the web transitions into a support wall offset by approximately 90°. This support wall has retaining lugs that latch onto a top side of the base facing away from the support element for holding the connection element on the cam follower. The retaining grips are supported on the inner sides of the side walls of the cam follower such that the U-shaped recess is essentially fixed in terms of its position in the perpendicular direction to the cam follower and in terms of its shape.

Here, the previously noted disadvantages are overcome with simple means. The construction of the connection element guarantees that the cam follower forms a captive connection to the support element and simultaneously its ability to tip about its longitudinal direction is minimized. The latter is mainly achieved in that the U-shaped recess surrounds the groove orthogonal to the pivoting direction of the cam follower without play. The prerequisite for this condition is that the support element can be mounted essentially simultaneously with the connection element on the cam follower. This happens in an intermediate assembly step, such that the connection element is initially located only on one side, i.e., either with the retaining grips or with the support wall behind the base, which surrounds the concave molding. In this assembly state, there is still sufficient spacing between the U-shaped recess of the connection element and the bottom side of the base, so that now the support element can be pushed between the limbs of the U-shaped recess with its annular groove. In a last assembly step, the spherical end of the support element is then brought into contact with the concave molding of the cam follower, while the retaining lugs of the retaining grips and the support wall are simultaneously clipped behind the base.

Thus, elastic deformation of the connection element, as occurs for later clipping of the support element, and also the associated assembly gap between the connection element and the annular groove are no longer necessary. The low elasticity requirement further allows the use of a connection element of greater material thickness, which effectively prevents tipping of the cam follower, also through high component stiffness, in addition to the freedom of play relative to the annular groove. Nevertheless, the material thickness of the limbs can be limited without a problem, so that the thickness is less than an axial width of the groove, so that the connection element is freely movable in the groove geometrically for pivoting movements of the cam follower in the actuation direction of the gas-exchange valve. In this respect, the connection element participates without deformation in the pivoting movement of the cam follower and also generates no additional friction when the gas-exchange valve is actuated.

The retaining grips preferably have an S-shaped, curved or equal action construction on an end section that includes the retaining lug. Such a shape of the retaining grips causes an extended and more stable support of the retaining grips in terms of torsion on the inner sides of the side walls of the cam follower. Moreover, in a first exemplary embodiment of the connection element, the assembly of the component is simplified, because the connection element can be suspended behind the base, which surrounds the concave molding, with play but with a captive connection during the assembly process.

According to a second preferred embodiment of the invention, the S-shaped or equal action end section of the retaining grips are provided with lateral pegs, which engage in corresponding groove-shaped recesses on the inner sides of the side walls of the cam follower supporting the retaining grips. This positive-fit construction provides additional security against undesired detachment of the connection element from the cam follower. Here, for example, in the critical operating states named above for the internal combustion engine, there is a residual risk that never can be completely ruled out.

The connection element should further preferably be comprised of a spring-like material, such as cold-hammered steel, for mounting on the cam follower. Alternatively, light metal or plastic, which is reinforced with fibers or particles, could also be used.

The lever-like cam follower is preferably a finger lever. This finger lever can have a sliding surface or especially preferred also a rotatably mounted roller as a cam contact surface. Finally, the finger lever should have a generally U-shaped cross section. Instead of the U-shaped cross section, only one U-type cross section or one H cross section or the like can also be provided. In combination with this feature, the finger lever is made from sheet-metal material. At this point, other materials suitable for this function are naturally also conceivable, that is, also plastics or finger levers formed through reshaping, wherein the U shape without a combination with the sheet-metal material is also included in the protective area of this invention.

BRIEF DESCRIPTION OF THE DRAWINGS

The invention is explained in more detail with reference to the attached drawings, in which embodiments are shown. Shown are.

DETAILED DESCRIPTION OF THE PREFERRED EMBODIMENTS

Figure 3:
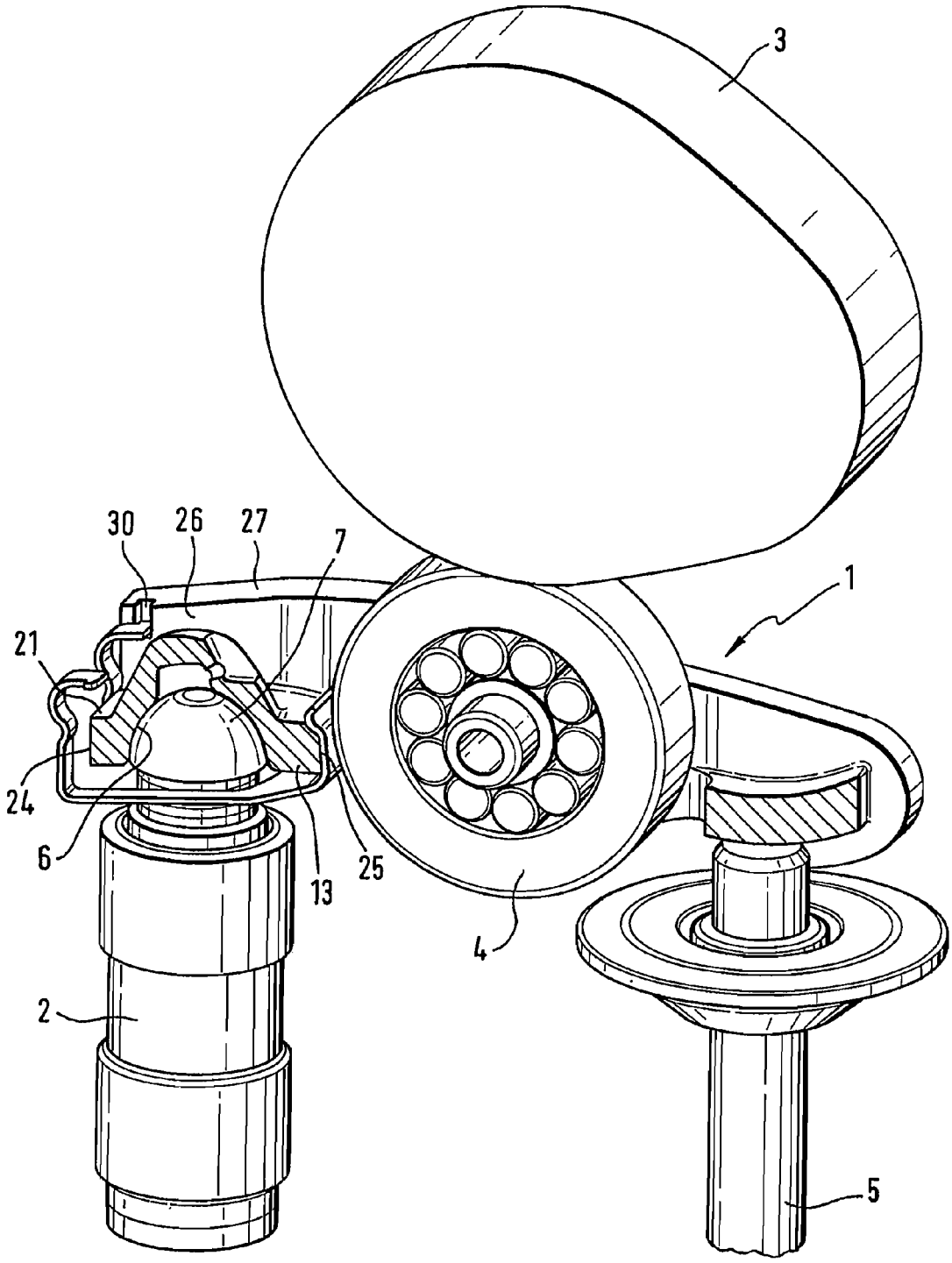
Figure 4:
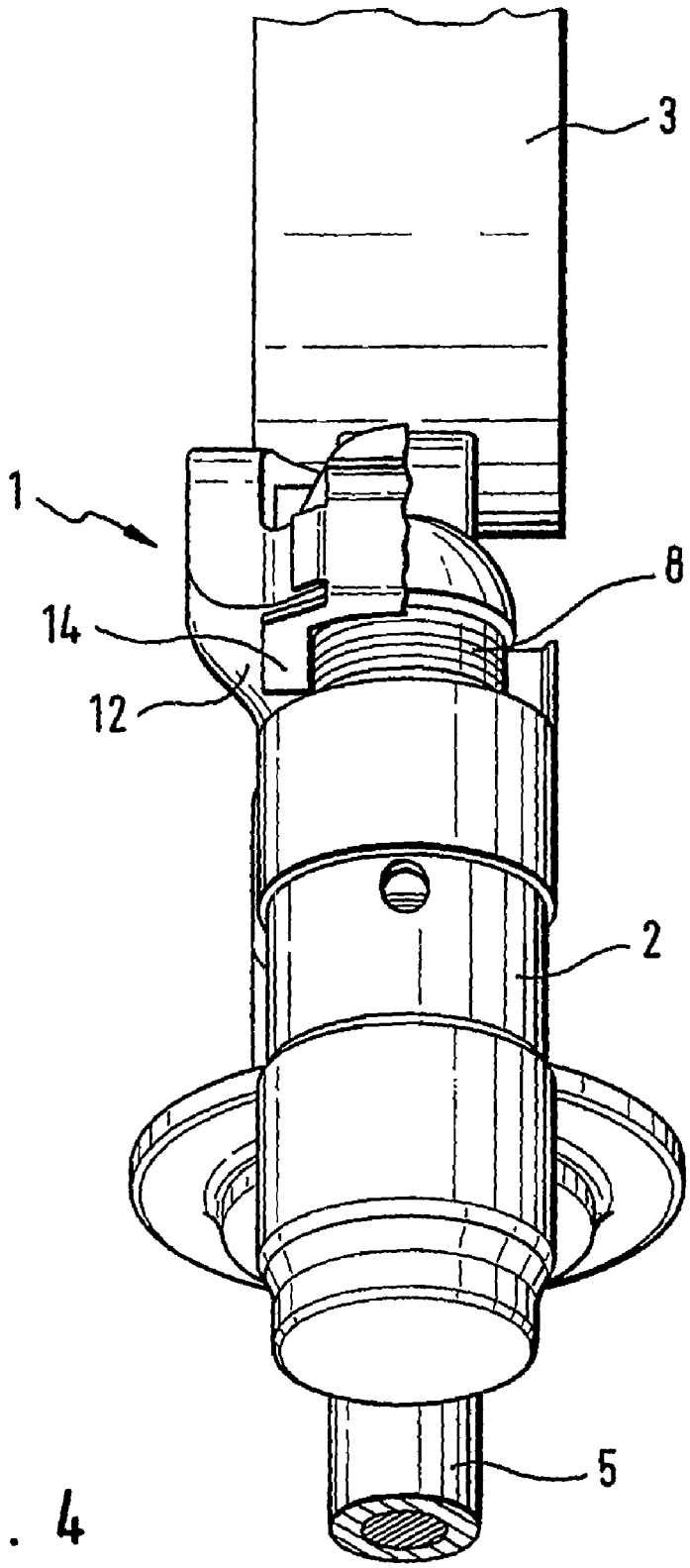

FIGS. 3 and 4 show a cam follower 1 and a support element 2, which supports the cam follower so that it can pivot and which is here constructed with hydraulic lash compensation that is not shown in more detail. The cam follower 1 is driven in a known way via a cam 3 by a roller 4 connected to the cam follower 1 and mounted rotatably in the actuation direction of a gas-exchange valve 5. Obviously, instead of the roller 4, a sliding surface connected rigidly to the cam follower 1 can also be provided as the cam contact. In the illustrated embodiment, the cam follower 1 is a finger lever, which has a U-shaped cross section and is preferably made from sheet-metal material in a reshaping process.

Figure 1:
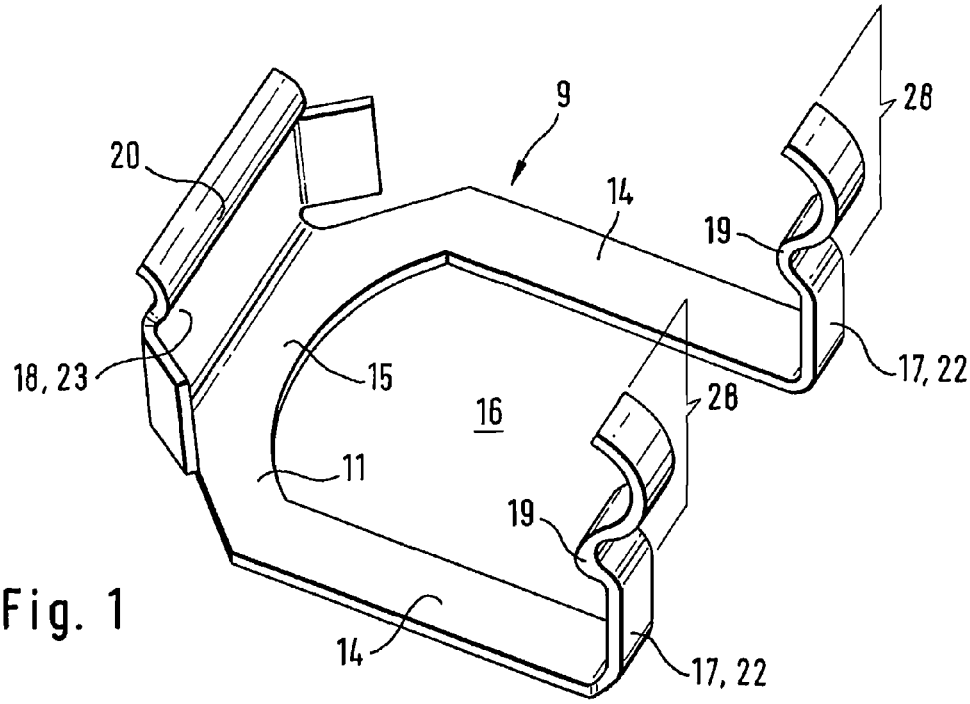
FIG. 1 a perspective view of a first embodiment for the connection element according to the invention, FIG. 2 a perspective view of a second embodiment for the connection element according to the invention, FIG. 3 a perspective view of the connection element according to FIG. 2 in the assembled state of the valve train for a cam follower shown in lateral cross-section, and FIG. 4 a rear view of the valve train in partial section with the connection element from FIG. 1.

As is further visible from the mentioned figures, the cam follower 1 has a concave molding 6, by which it is mounted on a spherical end 7 of the support element 2. Below the spherical end 7 there is an annular groove 8, in which a connection element 9 or 10 engages, as illustrated in the embodiments according to FIG. 1 and FIG. 2, respectively, as individual components. The connection element 9, 10 contacts a bottom side 12 of a base 13 facing the support element 2 with a central section 11. This base surrounds the concave molding 6. The central section 11 has two limbs 14, which are connected to each other by a web 15 and form a U-shaped recess 16 in the longitudinal direction of the cam follower 1. It is visible particularly from FIG. 4 that the limbs 14 surround the groove 8 without play perpendicular to the actuation direction of the cam follower 1.

The limbs 14 transition into retaining grips 17 offset by approximately 90° in a longitudinal direction of the cam follower 1. A support wall 18 similarly offset by approximately 90° is connected to the web 15. Here, retaining lugs 19, 20, which are engaged on a top side 21 of the base 13 that faces away from the support element 2 in the completely assembled state of the component formed from the cam follower 1, support element 2, and connection element 9, 10, are constructed on the retaining grips 17 and on the support wall 18. Therefore, the connection element 9, 10 is held on the cam follower 1 together with the support element 2 in the longitudinal direction of the support element 2. The connection element 9, 10 is fixed in the longitudinal direction of the cam follower 1 by the retaining grips 17 and the support wall 18, which surround ends 24, 25 of the base 13 with bottom sections 22, 23. Finally, the U-shaped recess 16 is aligned in the perpendicular direction to the cam follower 1, such that the retaining grips 17 are supported on the inner sides 26 of the side walls 27 of the cam follower 1.

The retaining grips 17 each have a preferably S-shaped, curved or equal action construction on an end section 28, which includes the retaining lug 19. This produces, on one hand, an extended support of the retaining grips 17 that is more stable in terms of torsion on the inner sides 26 of the side walls 27 of the cam follower 1.

On the other hand, the retaining grips 17 shaped in this way simplify the assembly of the component including the connection element 9, because the connection element 9 can initially be suspended on one side with play but with a captive connection behind the base 13, which surrounds the concave molding 6. In this partly assembled state there is still sufficient spacing between the U-shaped recess 16 of the connection element 9 and the bottom side 12 of the base 13, so that now the support element 2 can be pushed between the limbs 14 with its annular groove 8. In a last assembly step, the spherical end 7 of the support element 2 is brought into contact with the concave molding 6 of the cam follower 1, while the retaining lugs 19, 20 of the retaining grips 17 and the support wall 18 are simultaneously clipped onto the top side 21 of the base 13.

Figure 2:
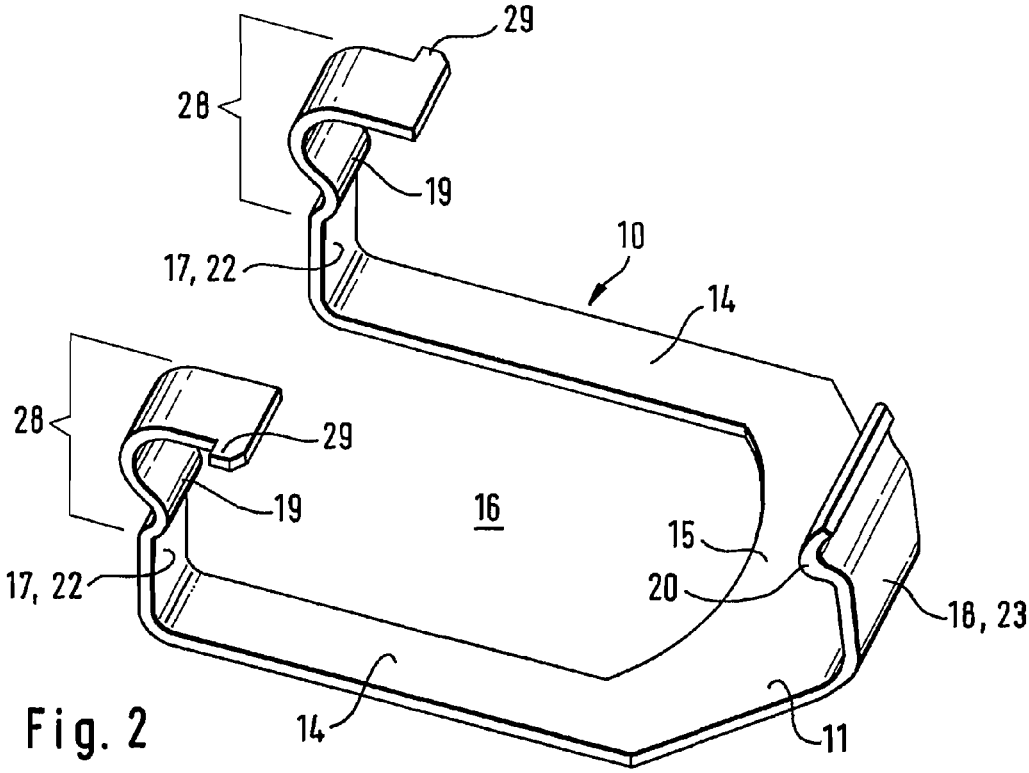

As can be identified easily in FIG. 2, the S-shaped, curved or equal action retaining grips 17 of the connection element 10 are also provided with lateral pegs 29. These pegs 29 are snapped with a positive fit into groove-shaped recesses 30 in the inner sides 26 of the side walls 27 of the cam follower 1. In this way, additional security is given against undesired detachment of the connection element 10 from the cam follower 1.

Because the annular groove 8 of the support element 2 is pushed between the limbs 14 of the connection element 9, 10 mounted in advance on the cam follower 1, the connection element 9, 10 can be constructed with a greater material thickness with low elasticity, in order to effectively prevent tipping of the cam follower 1 also through high component stiffness, in addition to the freedom from play relative to the groove 8.

Nevertheless, the limbs 14 have a material thickness that is less than the axial width of the groove 8. Thus, the connection element 9, 10 can move freely in the groove 8 in the actuation direction of the gas-exchange valve 5 for pivoting movements of the cam follower 1, so that it neither deforms nor contributes to friction when the internal combustion engine is running.

Naturally any materials can be used for the connection element 9, 10 according to the invention as long as the technical and also financial demands are satisfied. Thus, in addition to spring-like steel and light-metal materials, plastics, which can have particle or fiber reinforcement, are also obviously possible. Due to their low density, these materials have a negligible contribution to the moving masses of the valve train.

REFERENCE SYMBOLS

1 Cam follower
2 Support element
3 Cam
4 Roller
5 Gas-exchange valve
6 Concave molding
7 Spherical end
8 Groove
9 Connection element
10 Connection element
11 Central section
12 Bottom side
13 Base
14 Limb
15 Web
16 U-shaped recess
17 Retaining grip
18 Support wall
19 Retaining lug
20 Retaining lug
21 Top side
22 Bottom section
23 Bottom section
24 End
25 End
26 Inner side
27 Side wall
28 End section
29 Peg

The invention claimed is:

1. Connection element for the captive mounting of a lever-type cam follower, which is used to actuate a gas-exchange valve of an internal combustion engine, on a support element, which has a spherical end, on which the cam follower is pivotably mounted by a concave molding thereof, the connection element comprising a flat material has a central section, on a bottom side of a base of the cam follower facing the support element, the base surrounds the concave molding and connects to side walls of the cam follower, and the connection element forms, with two limbs that are spaced apart from each other and a web connected with the limbs, a U-shaped recess, which is arranged in a longitudinal direction of the cam follower and which surrounds an annular groove below the spherical end in a fork-like manner, the U-shaped recess surrounds the groove orthogonal to a pivoting direction of the cam follower essentially without play, the limbs transition into retaining grips offset by approximately 90° and the web transitions into a support wall offset by approximately 90°, with retaining lugs located on the retaining grips and the support wall, which are engageable on a top side of the base facing away from the support element for holding the connection element on the cam follower, the retaining grips are supported on inner sides of the side walls of the cam follower such that the U-shaped recess is essentially fixed in position in a perpendicular direction relative to the cam follower and in terms of a shape thereof.

2. Connection element according to claim 1, wherein at least one of the retaining grips has a generally S-shaped end section, which includes the retaining lug.

3. Connection element according to claim 2, wherein the end section has a lateral peg, which is engageable in a groove-shaped recess in the inner side of the side wall to support the retaining grip.

* * * * *